United States Patent [19]

Hirano

[11] 4,401,027

[45] Aug. 30, 1983

[54] PRINTING MECHANISM

[75] Inventor: Hirofumi Hirano, Arakawa, Japan

[73] Assignees: Canon Kabushiki Kaisha, Tokyo; Canon Denshi Kabushiki Kaisha, Saitama, both of Japan

[21] Appl. No.: 256,038

[22] Filed: Apr. 21, 1981

[30] Foreign Application Priority Data

Jun. 12, 1980 [JP] Japan ..... 55-78360

[51] Int. Cl.[3] ..... B41J 7/00

[52] U.S. Cl. ..... 101/106; 101/93.16; 101/99; 101/110

[58] Field of Search ..... 101/106, 110, 93.16, 101/103, 99; 400/158; 411/145

[56] References Cited

U.S. PATENT DOCUMENTS

| | | | |
|---|---|---|---|
| 3,734,012 | 5/1973 | Huggins | 101/103 |
| 3,771,442 | 11/1973 | Ditman | 101/99 |
| 3,807,301 | 4/1974 | Decker | 101/110 |
| 3,920,113 | 11/1975 | Tamai | 400/158 |
| 4,018,156 | 4/1977 | Giordano | 101/106 |
| 4,284,003 | 8/1981 | Tollet | 101/99 |

*Primary Examiner*—Edgar S. Burr
*Assistant Examiner*—Bradley M. Lewis
*Attorney, Agent, or Firm*—Fitzpatrick, Cella, Harper & Scinto

[57] ABSTRACT

A printing mechanism is disclosed which has a cylindrical type wheel rotatably supported on a driving shaft and carrying a plural number of types arranged on it circumferential surface at regular angular intervals and protruding from the surface. For effecting printing, one of the types is selected and the selected type is struck against a recording medium making use of a energy of rotation. The present invention is directed to improvement in such type of printer. The improvement comprises an elastic member through which the type wheel is supported on the driving shaft. The elastic member is fixed to the driving shaft. The type wheel is disposed concentrically with the driving shaft and spaced from a platen by a determined distance. The elastic member is engaged with projections formed on the inner circumferential surface of the type wheel so as to transmit rotation of the driving shaft to the wheel. After selecting a time point for printing a selected type, the type wheel is stopped rotating and moved, as a whole, toward the platen eccentrically to the driving shaft so as to strike the selected type against the platen for effecting printing. After printing, the elastic member is disengaged from the inner projections thereby allowing the type wheel to move back toward the driving shaft while the type wheel being still in the state substantially stopped rotating.

2 Claims, 4 Drawing Figures

PRINTING MECHANISM

BACKGROUND OF THE INVENTION

1. Field of the Invention

The present invention relates to a printing mechanism and more particularly to a printing mechanism for use in a data display apparatus comprising a type wheel supported on a driving shaft and carrying thereon characters and symbols to be printed.

2. Description of the Prior Art

Various types of printing mechanisms have been proposed. One type of printing mechanism which has been known and used is provided with one, two or more type wheels arranged in parallel and movable toward and away from a recording medium. The type wheel is moved toward the recording medium by a control apparatus for selecting and controlling the point in time for printing. Printing is effected by this swing motion of the type wheel. An example of such a type of printer having a swing movable type wheel(s) is disclosed in U.S. Pat. No. 3,807,301.

However, the arrangement disclosed in the above mentioned patent has some problems. In the arrangement, the type wheel and the type ring are connected by an elastic member, and the type ring is pushed toward the recording medium by a pawl. When the pawl is disengaged after printing, the type wheel is moved back by the elastic member in the same direction as the type ring. Therefore, the type on the surface of the recording medium attempts to move back while being rotated together with the type ring. This rotation of the type results in rubbing of the recording medium surface against the type and thus the printed character is rubbed and the trouble of so-called ghost is caused. This is particularly true in the case wherein the type wheel and types are formed of elastic material, such as rubber, and ink is applied to the types by an ink roller which is generally easy to operate and assures clear and sharp printing.

Also, in the known mechanism, the spring is continuously tensioned during printing and the pressure applied to the type under printing increases in proportion to the length of holding time by the pawl. Therefore, the intensity of printed characters on the recording medium is greatly affected by variation of the length of printing time. Furthermore, at the end of every printing, the pawl must be disengaged against the tension force of the spring. Accordingly, it is required to use a strong spring for returning the pawl to its home position. Consequently, a large electromagnet is required to drive the pawl, and therefore a large amount of electric power is required. For these reasons, it has been difficult to create a printer which is simple in structure and low in power consumption.

SUMMARY OF THE INVENTION

Accordingly, it is the principal object of the invention to provide a printing mechanism for use in a data display apparatus which is simple in structure and provides clear and sharp prints.

To attain the object according to the invention there is provided a printing mechanism comprising one, two or more type wheels arranged in parallel and movable toward a recording medium under the control of a control apparatus for selecting and controlling the printing time in which the rotation energy of the type wheel or the type wheel driving shaft normally rotating is used as printing force.

Other and further objects, features and advantages of the invention will appear more fully from the following description taken in connection with the accompanying drawings.

DESCRIPTION OF THE PREFERRED EMBODIMENTS

Figure 1:
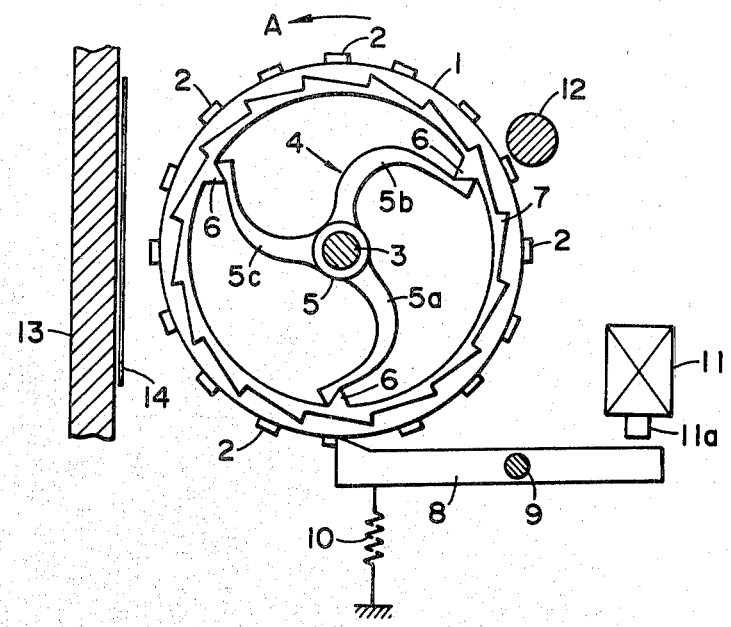
FIG. 1 is a sectional view of a printing mechanism showing an embodiment of the present invention in its rest position.

Referring first to the FIG. 1 embodiment of the invention, a type wheel is designated by 1. The type wheel 1 has a number of types 2 arranged on the circumference at regular angular intervals as viewed in the circumferential direction. The types 2 protrude upwardly from the circumferential surface of the wheel 1 as clearly seen in FIG. 1.

The type wheel 1 itself is formed of synthetic resin or the like as a unitary member. A driving shaft 3 passes through the center of the type wheel 1. The driving shaft 3 is disposed between a pair of side plates (not shown) and is rotatably supported by the side plates. A motor or the like (not shown) drives the shaft 3 in such a manner that the driving shaft 3 may continue rotating at a given uniform rotational speed so long as the printer is in operation.

Firmly fixed on the driving shaft 3 is an elastic member 4 which has a cylindrical portion 5 as its main portion. The cylindrical portion 5 is fitted on the driving shaft 3. Radial arms 5*a*–5*c* extend from the cylindrical portion 5 at equal angular intervals. The arms are all the same in shape and curved as shown in FIG. 1. The tip ends of the radial arms 5*a*–5*c* are always in contact with the inner circumferential surface of the type wheel 1 keeping a sufficient contact pressure between the radial arms and the inner surface of the type wheel to elastically support the type wheel 1 about the driving shaft 3. Inner projections 6 engageable with the tip ends of the radial arms 5*a*–5*c* are provided on the inner circumferential surface of the type wheel 1. The number of the inner projections 6 is equal to that of the radial arms 5*a*–5*c*. Through the engagement between inner projections 6 and radial arms 5*a*–5*c* the type wheel 1 can be driven by the driving shaft 3.

A ratchet wheel 7 is fixed to one end surface of the type wheel 1. In a suitable position to engage with the ratchet wheel 7 there is provided a pawl 8 which is supported by a pivot 9 at the middle of the length of the pawl for rotation about the pivot. A spring 10 is disposed between the end part of the pawl near the ratchet wheel and a stationary part of the printer. Above the other end part of the pawl 8, there is provided an electromagnet 11 for driving the pawl. When the electromagnet 11 is excited in the position shown in FIG. 1, its rod 11*a* is projected downwards against the rear portion of the pawl to make the pawl rotate clockwise about the pivot 9. Consequently, the front portion of the pawl 8 is moved upwards against the tension force of the spring 10 and the pawl is engaged by the ratchet wheel to hold the type wheel 1 in a position against rotation.

An ink roller 12 is suitably positioned in the vicinity of the circumference of the type wheel 1. The ink roller 12 is always in contact with the type 2 on the wheel 1 to apply ink to the surface of the type contacting with the roller at that time. Also, a platen 13 is disposed opposed to the type wheel 1. A recording medium such as printing paper 14 is fed into and between the platen 13 and the type wheel 1.

The manner of operation of the above described embodiment is as follows:

In the position shown in FIG. 1 in which the ratchet pawl 8 is disengaged, the inner surface of the type wheel is uniformly pressed radially by the elastic forces of the radial arms 5*a*–5*c* of the elastic member 4. Therefore, in this position, the axis of the type wheel 1 is coincident with the axis of the driving shaft 3. Namely, the type wheel and the driving shaft are concentric. Since the tip ends of the curved radial arms 5*a*–5*c* are in engagement with the respective inner projections 6 of the type wheel 1, the type wheel rotates together with the driving shaft 3 when it is driven by a motor (not shown) in the position shown in FIG. 1. Arrow A in FIG. 1 indicates the rotational direction of the type wheel.

Figure 2:
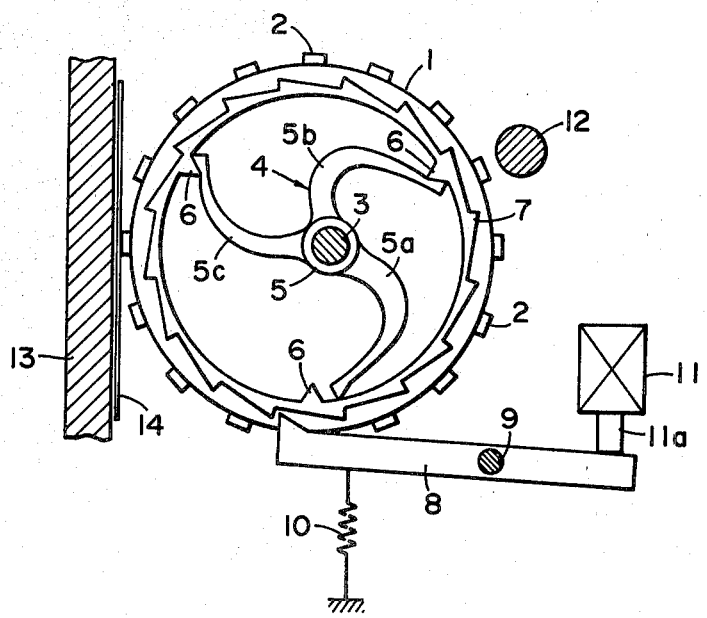
FIGS. 2 to 4 are sectional view thereof in different stages of operation illustrating the manner of operation of the embodiment.

During the rotation of the type wheel 1, one of the types 2 on the type wheel is selected by a key or data memory in a manner known. In time after the selection of type, the electromagnet 11 is energized through a controller (not shown). As a result, the ratchet pawl 8 is rotated clockwise about the pivot 9 as viewed in the drawing. Thus, the pawl move into engagement with one of ratchets of the ratchet wheel 7 to prevent further rotation of the type wheel 1. However, the motor continues to apply torque to the driving shaft 3 which, therefore, further rotates the type wheel. This results in flexing of radial arms 5*a*–5*c* as shown in FIG. 2. The concentricity of the shaft 3 and the type wheel 1 is broken thereby and the center of the shaft is deviated from the center of the type wheel 1. This deviation produces a composite movement by which the type wheel 1 is moved toward the platen 13. The driving shaft 3 continues rotating in the direction of arrow A until the type wheel 1 gets in contact with the platen 13. During the time, one or two of the radial arms 5*a*–5*c* are disengaged from the inner projections 6. However, at least one of the arms remains engaged with the projection. Therefore, the type wheel 1 is pushed against the platen 13 and the selected type 2 on the type wheel is pressed against the platen through the recording medium 14 to effect printing as seen in FIG. 2.

Figure 3:
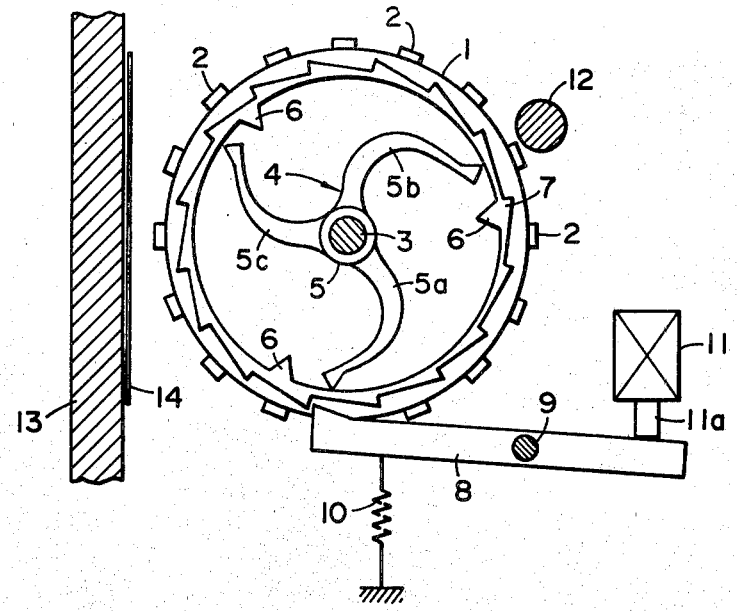

During the period from the beginning of deviation of the type wheel 1 from the center of the driving shaft 3 to a point in time not so long after the completion of the printing, all of the radial arms 5*a*–5*c* become disengaged from the corresponding inner projections as shown in FIG. 3. In the position shown in FIG. 3, therefore, the tip ends of all the radial arms 5*a*–5*c* are in contact directly with the inner circumferential surface of the type wheel 1.

The time length during which the selected type 2 is being pressed against the recording medium 14 can be changed by suitably changing the shape of the projections 6 formed on the inner circumferential surface of the type wheel 1.

At the time point when all of the radial arms 5*a*–5*c* have slid over the projections 6, the type wheel 1 is restored to the original position concentric with the driving shaft 3 in a moment owing to the elastic spring force which the radial arms 5*a*–5*c* equally possess. At this time point, the pawl 8 still remains engaged in the ratchet wheel 7 as shown in FIG. 3.

Figure 4:
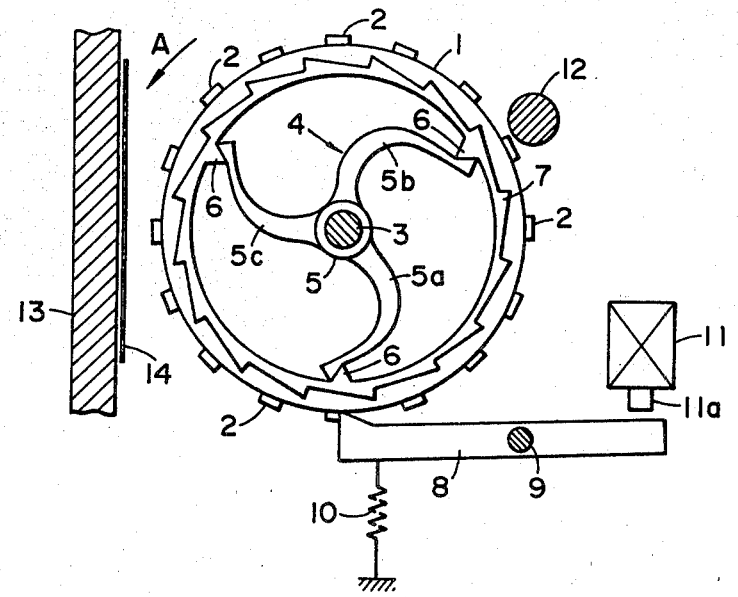

At a suitably selected point in time after the type wheel 1 and the radial arms 5*a*–5*c* have gotten in the position shown in FIG. 3, the supply of current to the electromagnet 11 is cut off and the pawl 8 is returned to the starting position by the spring 10. Thus, the pawl 3 is disengaged from the ratchet wheel 7. During the disengagement of the pawl from the ratchet wheel, the driving shaft 3 and therefore also the elastic member 4, are further rotated. Therefore, the tip ends of the respective radial arms 5*a*–5*c* slidingly move along the inner circumference of the type wheel 1 until they re-engage the corresponding inner projections 6 as shown in FIG. 4. After the pawl 8 has been disengaged from the ratchet wheel 7 and the radial arms 5*a*–5*c* have re-engaged the inner projections 6, the type wheel 1 again starts rotating for the next printing operation.

The embodiment of the present invention described above has the following advantages:

Firstly, since the elastic member for driving the type wheel serves also as a member for bringing the type wheel into printing operation, it is possible to receive the components required for rotating the type wheel and for shifting it to the printing position within the type wheel itself. Therefore, there is obtained a printer which is simple in structure and small in size.

Secondly, the energy with which printing is executed can be controlled by the elastic member. Namely, the printing pressure can be controlled by the elastic member independently of the holding time for holding the type wheel in the printing position. Therefore, uniform print is obtainable.

Thirdly, the problem of ghost is eliminated and clear print can be obtained. At the end of every printing motion, the type wheel is returned to its home position in a moment by the elastic spring force of the elastic member itself. Therefore, even when the type wheel is unlocked and restarted rotating immediately after its return to the home position there occurs no problem of the recording medium being rubbed with the type on the wheel which often happened in prior art printers. Since the types on the type wheel never rub the recording medium surface, no ghost is caused and clear print is assured.

Lastly, a substantial saving of electric power is attainable according to the invention. In the embodiment of the invention described above, only a small force needs to be applied to the ratchet pawl 8 during the time from the restoration of the type wheel's original position to the deengagement of the radial arms from the inner projections. During the time, the radial arms rotate merely sliding on the inner surface of the type wheel. Therefore, the spring for returning the ratchet pawl 8 need not be so strong a spring force. A very small spring force is sufficient for the purpose. This makes it possible to reduce to the minimum magnet force required for driving the ratchet pawl. As a result, a power saving type of printer can be realized.

As readily understood from the foregoing, the printer of the present invention is featured by the provision of an elastic member having a plural number of arms through which a hollow type wheel is connected to a driving shaft. The elastic member is useful for two different purposes, that is, as means for driving the type wheel into rotation and also as means for bringing the same into printing operation. Due to this novel feature of the printer, according to this invention, is simple in structure and easy to manufacture.

While the present invention has been particularly shown and described with reference to a preferred embodiment thereof, it will be understood by those skilled in the art that many modifications and variations of the present invention are possible without departing from the spirit and scope of the invention.

What I claim is:

1. A printing mechanism comprising: a cylindrical type wheel having a circumferential surface with a plurality of types arranged at equal angular intervals on the outside thereof and a plurality of projections arranged at equal angular intervals on the inside thereof; a continuously rotatable drive shaft disposed inside of and associated with said type wheel for rotating said type wheel;

a stop means for stopping rotation of said type wheel to print a selected type, and drive means to both rotate said type wheel without effecting printing and to provide energy to effect printing by said type wheel in response to actuation of said stop means, said drive means including an elastic member fixed on said drive shaft and having a plurality of resilient arms for supporting said type wheel and for disposing said type wheel concentric to said drive means;

wherein said elastic member normally spacing the plurality of types provided on said type wheel from a platen by a predetermined distance, an end of at least one of said plurality of resilient arms contacting one of said plurality of projections to rotate said type wheel without effecting printing, said stop means being movable to engage said type wheel to stop rotation thereof relative to said drive shaft and cause said type wheel to rotate about the point of said type wheel which is engaged by said stop means in an eccentric path relative to said shaft by utilizing energy produced by the contact of at least one of the ends of said plurality of arms with at least one of said plurality of projections so that said type wheel strikes a selected type against the platen to cause printing, actuation of said stop means and striking of a selected type against said platen causing said continuously rotated drive shaft to rotate said resilient arms over and past said projections thereby terminating the rotation of said type wheel by said elastic member and completely separating said resilient arms from said projections, at least one of said resilient arms reestablishing a driving contact with one of said projections subsequent to said type wheel being separated from the recording medium.

2. A printing mechanism as set forth in claim 1, wherein said type wheel is contacted by an ink roller.

* * * * *

UNITED STATES PATENT AND TRADEMARK OFFICE

CERTIFICATE OF CORRECTION

PATENT NO. : 4,401,027

DATED : August 30, 1983

INVENTOR(S) : HIROFUMI HIRANO

It is certified that error appears in the above-identified patent and that said Letters Patent is hereby corrected as shown below:

IN THE ABSTRACT line 3, "it" should read --its--;

line 7, "a energy" should read --energy--;

line 8, "to" should read --to an--;

line 9, "such" should read --such a--;

line 18, "a time point" should read --a point in time--;

line 19, "is stopped" should read --stops--;

line 19, "moved" should read --moves--;

line 25, change "being still in the state" to --has--.

Col. 3, line 30, "move" should read --moves--.

Signed and Sealed this

*Third* Day of *July 1984*

[SEAL]

*Attest:*

GERALD J. MOSSINGHOFF

*Attesting Officer*

*Commissioner of Patents and Trademarks*